US012729595B2

(12) United States Patent
Krogsæter et al.

(10) Patent No.: US 12,729,595 B2
(45) Date of Patent: Sep. 8, 2026

(54) AXIAL POSITION-CONTROLLED OPERATION TOOLSTRING AND METHOD

(71) Applicant: ARCHER OILTOOLS AS, Stavanger (NO)

(72) Inventors: Kurt Luis Krogsæter, Nesttun (NO); Jan-Ove Fagna, Tertnes (NO); Atle Løland, Bryne (NO); Bjørn Tore Torvestad, Stavanger (NO)

(73) Assignee: ARCHER OILTOOLS AS, Stavanger (NO)

( * ) Notice: Subject to any disclaimer, the term of this patent is extended or adjusted under 35 U.S.C. 154(b) by 31 days.

(21) Appl. No.: 18/288,980

(22) PCT Filed: May 2, 2022

(86) PCT No.: PCT/NO2022/050102
§ 371 (c)(1),
(2) Date: Oct. 30, 2023

(87) PCT Pub. No.: WO2022/231438
PCT Pub. Date: Nov. 3, 2022

(65) Prior Publication Data

US 2024/0209707 A1 Jun. 27, 2024

(30) Foreign Application Priority Data

Apr. 30, 2021 (NO) ..... 20210537

(51) Int. Cl.
*E21B 31/16* (2006.01)
*E21B 23/03* (2006.01)
(Continued)

(52) U.S. Cl.
CPC ..... *E21B 31/16* (2013.01); *E21B 23/03* (2013.01); *E21B 29/005* (2013.01); *E21B 31/20* (2013.01)

(58) Field of Classification Search
CPC ..... E21B 23/03; E21B 23/02; E21B 29/005; E21B 31/16; E21B 31/20
See application file for complete search history.

(56) References Cited

U.S. PATENT DOCUMENTS 4,191,255 A * 3/1980 Rives ..... E21B 31/16 175/207
6,012,527 A 1/2000 Nitis et al.
(Continued)

FOREIGN PATENT DOCUMENTS

GB 2251015 A 6/1992
GB 2568815 A 5/2019
(Continued)

OTHER PUBLICATIONS

International Preliminary Report on Patentability for PCT/NO2022/050102 completed on Mar. 30, 2023.
(Continued)

*Primary Examiner* — Nicole Coy
*Assistant Examiner* — Jennifer A Railey
(74) *Attorney, Agent, or Firm* — Birch, Stewart, Kolasch & Birch, LLP

(57) ABSTRACT

An axial position-controlled operation toolstring for conducting an axial position-controlled operation in a well includes from below and up: a casing cutter tool including knives; a tag sub with dogs arranged for landing on a protrusion in said well; a pipe spear; and a drill pipe string. The knives of the casing cutter tool are spaced out a predetermined initial distance below the dogs of the tag sub. The dogs are arranged for being collapsible by weight loading against the protrusion. A method includes using the toolstring.

25 Claims, 4 Drawing Sheets

(51) Int. Cl.
*E21B 29/00* (2006.01)
*E21B 31/20* (2006.01)

(56) References Cited

U.S. PATENT DOCUMENTS

| | | | | |
|---|---|---|---|---|
| 6,679,328 | B2 * | 1/2004 | Davis | E21B 29/005 175/267 |
| 2002/0060076 | A1 | 5/2002 | Harrell | |
| 2002/0162659 | A1 | 11/2002 | Davis et al. | |
| 2004/0079534 | A1 * | 4/2004 | Harrall | E21B 43/106 166/380 |
| 2015/0275605 | A1 * | 10/2015 | Bennett | E21B 10/32 166/55.1 |
| 2015/0368983 | A1 * | 12/2015 | Perez | E21B 17/028 166/378 |
| 2018/0135372 | A1 * | 5/2018 | DeGeare | E21B 33/134 |
| 2021/0115747 | A1 * | 4/2021 | Stokes | E21B 31/20 |
| 2021/0355778 | A1 * | 11/2021 | Kristiansen | E21B 31/20 |

FOREIGN PATENT DOCUMENTS

| | | | |
|---|---|---|---|
| GB | 2574647 | A | 12/2019 |
| GB | 2576010 | A | 2/2020 |
| WO | WO 2018/203062 | A1 | 11/2018 |

OTHER PUBLICATIONS

International Search Report for PCT/NO2022/050102 mailed on Jul. 8, 2022.
Written Opinion of the International Searching Authority for PCT/NO2022/050102 mailed on Jul. 8, 2022.

* cited by examiner

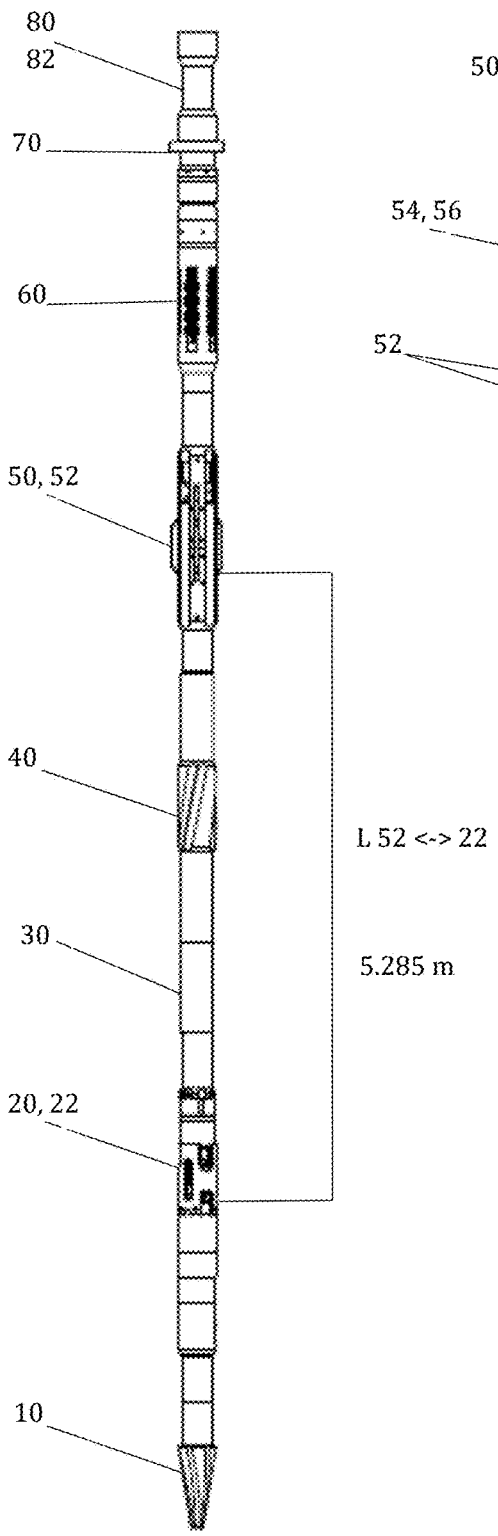
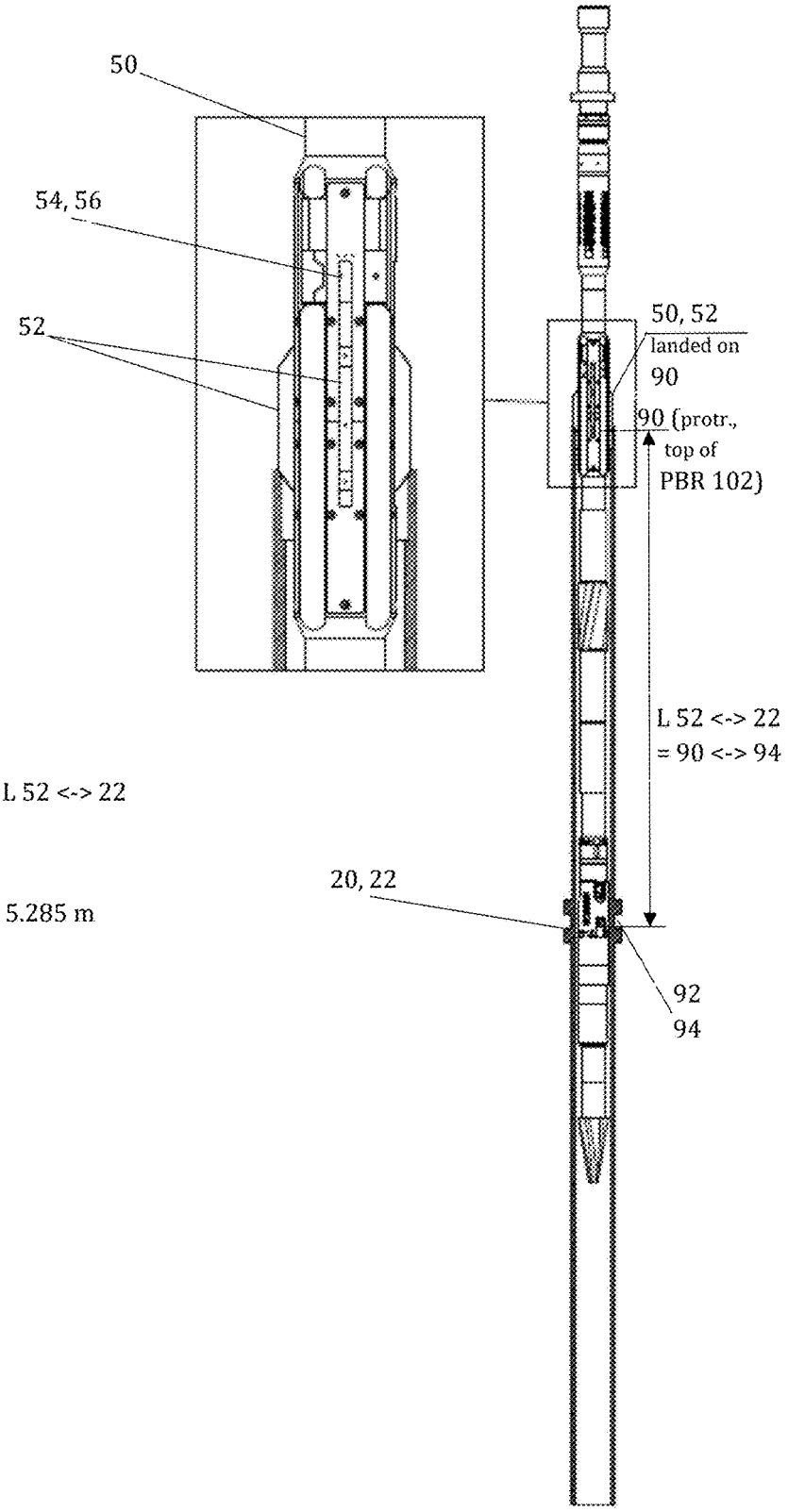
Fig. 1 BHA
Fig. 2

AXIAL POSITION-CONTROLLED OPERATION TOOLSTRING AND METHOD

FIELD OF THE INVENTION

An axial position-controlled operation toolstring for conducting an axial position-controlled operation in a well. The invention also relates to a method for conducting an axial position-controlled operation in a well.

BACKGROUND OF THE INVENTION

Operations performed in a well often requires exact depth control. When such operations are to be carried out deep down in the well on components previously installed it is not possible to control the depth from surface. The workstring that is used to convey tools down the well for performing the well operation is subjected to factors such as compression, stretch and thermal expansion. Hence, simply keeping track of the length of the workstring entering the well will not give a good enough control of the depth of the tools. The length of the workstring is often several thousand meters and tools in the bottom hole assembly typically have to be positioned within a few meters. For some applications the error margin is far less and in the range of centimetres.

When a production tubing, a casing or a liner string is installed in a well an exact tally is recorded. The tally comprises the serial number, the exact length and specifics of every tubular that makes up the string. Hence, the exact length between components of the string can be found in the tally and when the components are not too far from each other the effect of stretch, compression and thermal expansion etc. is negligible. Thus, components that can be sensed or recognized from surface can be used to locate the exact depth of other nearby components in the well.

Typically pup joints or radioactive markers are installed in the well to be used for depth control later. For locating pup joints or radioactive markers specialized tools are needed which are not always possible or desirable to include in a toolstring. Another possibility is to use protrusions in the well such as the PBR on the top of a liner. To locate the top of the PBR a component with a larger OD is included in the toolstring often referred to as a no-go. The no-go has a larger OD than the ID of the protrusion. A drawback of using a no-go is that the toolstring cannot pass the protrusion. In case the next step in the operation requires running further into the well there is no other option than pulling out of hole to remove the no-go.

US 2015/0275605 A1 describes a downhole tool with a bridge plug releasably coupled to a casing cutting tool. The bridge plug is set within a wellbore and the casing cutting tool may be used in a milling or perforating operation during a single downhole trip of the downhole tool. A method for using a downhole tool includes setting the bridge plug in a wellbore and performing a casing cutting operation during a same downhole trip.

GB2568815 A describes a casing recovery in which clean-up of the outer casing above the inner casing is performed on the same trip in the wellbore as cutting and pulling a section of the inner casing. A bottom hole assembly (BHA) includes a spear for gripping a casing that is going to be cut, a casing cutter and at least one clean-up tool, for removing binding material above casing that is going to be cut.

U.S. Pat. No. 6,012,527 describes a method and apparatus for landing and orienting selected tools to selected depths within a well casing. The well casing is provided with a plurality of casing nipples located at selected depths with each of the landing and orienting joints defining a differing internal landing profile. A landing orientation tool is adapted to be run into the casing and has an outer tubular body mandrel positioning a plurality of landing dogs for landing engagement with a matching landing profile. The tool being run will pass through non-matching landing and orienting joints and will land only when its landing dogs have a landing profile matching the profile of a landing and orienting joint.

Objects of the Present Invention

One object of the invention is to provide a downhole toolstring and a method for performing a precision cut to cut loose a section of a tubular below a protrusion in a well and thereafter retrieving said section.

Another object of the invention is to provide a method and a toolstring for cutting the slips of a liner to loosen it from the casing and retrieve the PBR.

SUMMARY OF THE INVENTION

The invention relates to an axial position-controlled operation toolstring for conducting an axial position-controlled operation in a well.

The toolstring comprises from below and up:

- a casing cutter tool comprising knives;
- a tag sub with dogs arranged for landing on a protrusion in said well;
- a pipe spear;
- a drill pipe string,
- wherein said knives of said casing cutter tool are spaced out a predetermined initial distance below the dogs of the tag sub; and
- wherein said dogs are arranged for being collapsible by weight loading against said protrusion.

The toolstring can further comprises a mud motor arranged for rotating said casing cutter tool.

The toolstring can further comprise a rotatable taper mill.

The toolstring can comprise a spaceout pipe string arranged above or below said mud motor.

The tag sub can comprise a mandrel and said tag sub's tag dogs can be arranged in and protruding from slots in the mandrel, said tag dogs can be arranged for collapsing into said slots when weight-loaded on said protrusion.

The tag dogs can be fixed in said mandrel with shear pins arranged for being sheared out by said weight loading against said protrusion so as for said tag dogs to slide upwardly and inwardly in said slots.

The toolstring can further comprise a no-go sub arranged above said spear, closer than the distance (L).

The mandrel can have an axial through bore so as for conducting flow from the above drill pipe string to said mud motor and said cutter tool.

In another aspect the invention relates to a method for conducting an axial position-controlled operation in a well.

The method comprises the steps of:

a) assembling the above described toolstring
b) running said toolstring into a well
c) landing the dogs of said tag sub on a protrusion in the well, thus positioning said knives of said cutter tool at said predetermined distance below said protrusion;
d) rotating the knives of the cutter tool, thus cutting free a pipe component of said well,
e) weight loading said dog to collapse to move said tag sub downwardly past said protrusion of said well, f) running said pipe spear into said cut free pipe component, g) setting said pipe spear in said cut free pipe component, and h) pulling said cut free pipe component out of hole.

Step f) can include running said pipe spear into said cut free pipe component until a no-go sub lands on said protrusion.

Step d) can include rotating said knives by rotating the drill pipe string from surface or rotating said knives by running a mud motor that is included in the toolstring above the casing cutter tool.

The pipe component can be a polished bore receptacle, and the knives can cut the slips and/or the slips lock thus freeing said polished bore receptacle.

DESCRIPTION OF THE FIGURES

Embodiments of the present invention will now be described, by way of example only, with reference to the following figures, wherein:

FIG. 1 shows a schematic view of an embodiment of a toolstring according to the invention. L is the length between dogs 52 and knives 22 of cutter tool 20

FIG. 2 shows the toolstring according to FIG. 1 entering a PBR at the top of a liner and the tag sub has landed on the top of the PBR.

Figure 3:
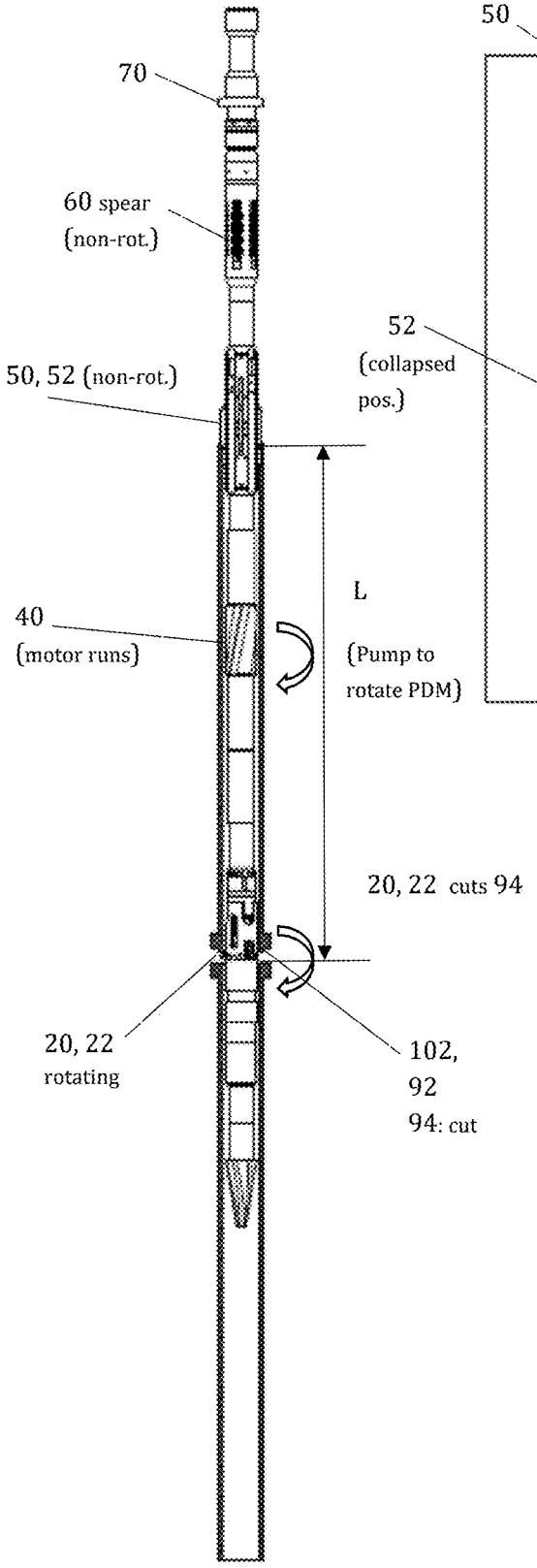
FIG. 3 shows the toolstring according to FIG. 1 while the casing cutter tool 20 with knives 22 is rotating to cut the liner and the slips lock 94 holding the liner. The cutter tool 20 with knives 22 cuts free the PBR held by the slips.

| Reference numbers | |
|---|---|
| 10 | Taper mill |
| 20 | Casing cutter tool |
| 30 | Space out |
| 40 | Mud motor |
| 50 | Tag sub |
| 51 | Through bore of mandrel 56 |
| 52 | Tag dogs |
| 54 | Dog slots |
| 56 | Mandrel (of Tag sub) |
| 60 | Spear |
| 70 | No-go sub |
| 80 | Drill pipe string |
| 82 | Handling joint |
| 90 | Protrusion in the well |
| 92 | PBR slips (liner hanger) |
| 94 | slips lock |
| 102 | PBR (Polish Bore Receptacle) |

DESCRIPTION OF EMBODIMENTS OF THE INVENTION

The relative terms "above" and "below" used throughout this description in relation to the position of the different components of the toolstring shall be understood as referring to the order in which the components are installed and inserted into the well from topside/surface, although the actual position after entering the well may be different, as the direction of the wellbore may deviate from vertical.

In one embodiment the toolstring 1 comprises a casing cutter tool 20, a tag sub 50, a spear 60 and a drill pipe string 80.

The casing cutter tool 20 comprises knives 22 and is configured to cut through a tubular surrounding the casing cutter tool 20.

The tag sub 50 is placed above the cutter tool 20. The purpose of the tag sub 50 is to land on a particular protrusion in a well. When the tag sub 50 lands, the driller knows that the toolstring has reached a particular depth. The tag sub 50 comprises a mandrel 56 and tag dogs 52 that can collapse radially into dog slots 54. This enables the tag sub 50 after collapsing the tag dogs 52 to enter a tubular with a smaller ID than before collapsing the tag dogs 52. In one possible embodiment each tag dog 52 is secured in a dog slot 54 in the mandrel 56 by screws or bolts with a predefined shear value. The dog slots 54 are axial slots along the outside of the mandrel 56. The depth of the dog slots 54 increases towards the end of the mandrel 56 that is intended to point upwards in the well (the end that points towards the surface). The tag dogs 52 are secured towards the shallow end of the dog slots 54. When a weight above a predetermined threshold is set down in the drill pipe string 80 while the tag dogs 52 is resting on a protrusion 90 in the well, the shear screws or bolts will shear and the tag dogs 52 will slide up towards the deepest end of the dog slots 54, thus collapse/retract into the mandrel 56. A ratchet mechanism, springs or similar can be used to keep the tag dogs 52 in position after the shear screws or bolts is sheared so the tag dogs 52 are kept in the collapsed configuration.

The tag sub 50 needs to be spaced out so that the knives 22 of the casing cutter tool 20 gets the desired depth from the protrusion that the tag dogs 52 are landed on. For spacing out, crossovers, pup joints and pipe joints can be used as during any other operation that requires a particular space out.

The spear 60 is placed above the tag sub 50 in the toolstring 1 and is configured to grip a section of a tubular cut loose by the casing cutter tool 20. Various types of spears 60 can be used such as an Itco Spear.

In a preferred embodiment the toolstring further comprises a no-go sub 70 above the spear 60. The purpose of the no-go sub 70 is to prevent the spear 60 to move down deeper than the depth of the cut that is made. The purpose of said no-go sub 70 is to prevent the spear 60 from ending up further below the protrusion 90 than the distance (L), i.e. below the cut-free pipe component 100. When the weight is set down for shearing the tag dogs 52 out the drill pipe string 80 is in compression and when the tag dogs 52 are sheared the toolstring 1 can suddenly move down. In case the distance between the protrusion and the cut is relatively short, it can happen that the spear 60, due to this sudden movement, will be moved past the cut. The no-go sub will prevent this from happening.

The described toolstring 1 is particularly suitable for cutting of a PBR (Polished Bore Receptacle) at the top of a liner and retrieving said cut loose PBR to surface. The top of the liner/PBR is secured to the casing by PBR slips 92 (liner hanger) and the PBR 102 is extending into the casing above said PBR slips 92. For various reasons it might be needed to cut said slips to release the liner from the casing and pull the PBR to the surface. To be able to release the liner from the casing a cut must be made exactly in the region of the PBR slips 102 to sever the slips lock/slips mechanism 94. The error margin for where the cut is to be made is very small and often in the range of centimeters. To make such a cut, a reference point down in the well must be used to position the knives 22 of the casing cutter 20.

Since the top of the liner PBR is typically several thousand meters down in the well it is desirable to perform both the cut and the retrieval of the top of the liner on one trip into the well. If the top of the liner is at 5000-meter measured depth (mMD), this will be 16-20 hours or more of tripping time saved if the operation can be done on one trip compared to two trips.

Before the cut is made it is not desirable to enter the PBR 102 with a spear 60. In particular, it is not desirable to enter the PBR 102 with a spear 60 and land on the PBR 102 with a no-go sub 70 above the spear 60. This is since for some types of spears 60 it is necessary to set down weight to disengage. With a no-go sub resting on the top of the liner it will not be possible to set down weight to disengage the spear 60 if it has engaged the PBR 102. In such a case the toolstring 1 will be stuck in the hole if the cut is not successful.

The operational sequence for retrieving the PBR can be as follows.

Assemble the toolstring (the BHA) on surface/drill floor as seen in FIG. 1. The knives 22 should be spaced out from the tag sub 50 so that the length L of the space out is equivalent to the length between the top of the PBR 102, i.e. the top of protrusion 90, and the center of the slips lock/mechanism 94 of the PBR slips 92.

Run the toolstring 1 into the well on the drill pipe string 80.

Figure 6:
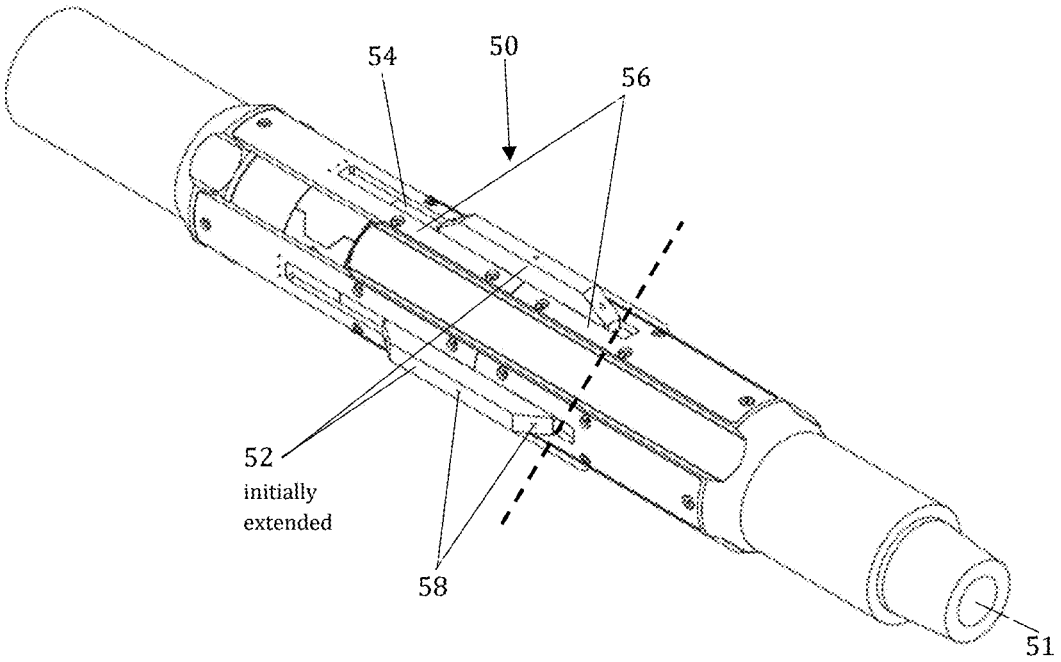
FIG. 6 shows an embodiment of the tag sub with the tag dogs extended

Enter the PBR 102 with the toolstring 1 and land the tag sub 50 on the protrusion 90, the top of the PBR 102 as seen in FIG. 2. The tag dogs 52 are in their extended position, as when resting on the top of the PBR 102, is seen in an enlarged view in FIG. 6.

Rotate the knives 22 to cut the liner and to sever the slips lock 94. The rotation of the knives 22 can either be done by rotating the whole toolstring 1 from surface or by using a downhole motor as seen in FIG. 3.

Figure 4:
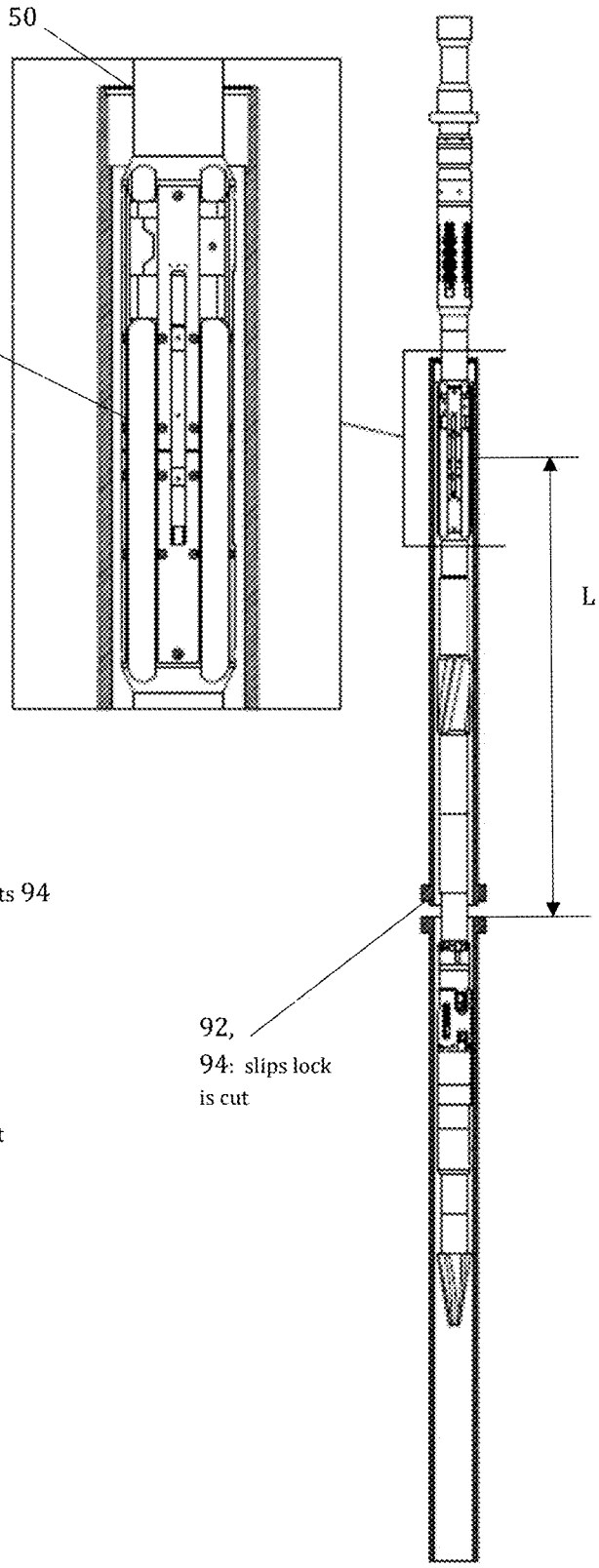
FIG. 4 shows the toolstring according to FIG. 1 after the dogs 52 of the tag sub 50 have collapsed and the tag sub 50 has moved into the PBR. Set down weight to release the dogs 52 of tag & shear sub 50.
Figure 7:
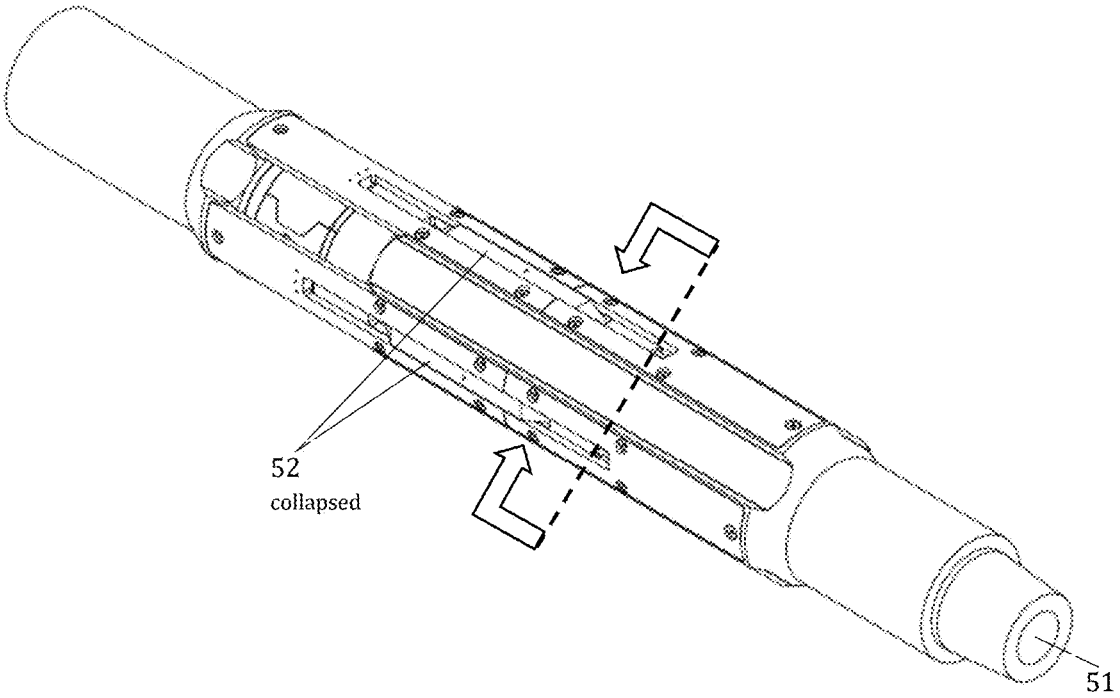
FIG. 7 shows an embodiment of the tag sub with the tag dogs collapsed

Weight load the dogs 52 by setting down weight in the drill pipe string 80 while the dogs 52 are resting on the top 90 of the PBR 102. The dogs 52 will be set up to shear at a predetermine force. When reaching the predetermined force, the dogs 52 will collapse as seen in FIG. 4. The tag sub 50 with the collapsed tag dogs 52 is seen in an enlarged view in FIG. 7.

Figure 5:
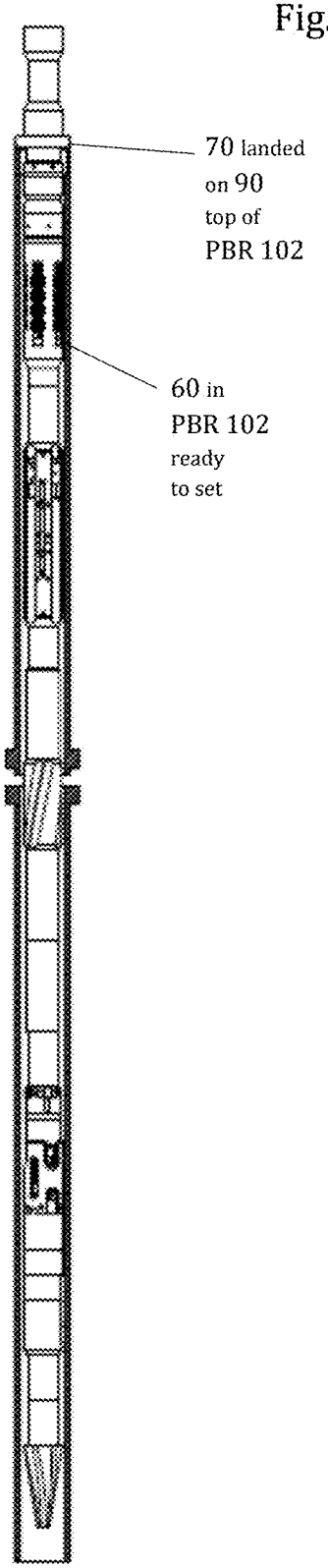
FIG. 5 shows the toolstring according to FIG. 1 after the spear has entered the PBR and the no-go has landed on the top of the PBR. The workstring enters the top PBR to engage spear and pull PBR.

Running the spear 60 into the PBR 102 until the no-go sub 70 rests on the top of the PBR 102, thus positioning the spear 60 inside the cut-off PBR 102 as seen in FIG. 5. The operation can also be performed without a no-go sub 70, then the spear 60 is run inside until the spear slips/grapples are inside the PBR 102 and stopped before they reach the cut. How desirable it is to include a no-go sub 70 in the toolstring 1 depends mainly on the depth of the PBR 102 and the distance between the top 90 of the PBR 102 and the cut, thus the no-go sub 70 is considered an optional feature.

Engage the spear 60 in the PBR 102.

Pull the toolstring 1 with the cut loose PBR 102 to surface.

The invention claimed is:

1. An axial position-controlled operation toolstring for conducting an axial position-controlled operation for releasing a pipe component in a well, comprising from below and up:

a casing cutter tool comprising knives;

a tag sub with dogs arranged for landing on a protrusion in said well;

a pipe spear; and a drill pipe string, wherein said knives of said casing cutter tool are spaced out a predetermined initial distance L below said dogs of said tag sub, wherein said pipe component is a polished bore receptacle, and said knives are arranged to cut slips and/or a slips lock of said polished bore receptacle thus freeing said polished bore receptacle, and wherein said dogs of said tag sub are arranged for being collapsible by weight loading against said protrusion, wherein said tag sub comprises a mandrel and said dogs of said tag sub are arranged in and protruding from slots in said mandrel, said dogs of said tag sub are arranged for collapsing into said slots when weight-loaded on said protrusion, and wherein said dogs of said tag sub are fixed in said mandrel with shear pins arranged for being sheared out by said weight loading against said protrusion so as for said dogs of said tag sub to slide upwardly and inwardly in said slots.

2. The toolstring of claim 1, wherein said toolstring further comprises a mud motor arranged for rotating said casing cutter tool.

3. The toolstring of claim 2, wherein said toolstring comprises a spaceout pipe string arranged above or below said mud motor.

4. The toolstring of claim 3, further comprising a no-go sub arranged above said pipe spear, closer than said predetermined initial distance L.

5. The toolstring of claim 3, wherein said mandrel has an axial through bore so as for conducting flow from said drill pipe string to said mud motor and said casing cutter tool.

6. The toolstring of claim 2, further comprising a rotatable taper mill.

7. The toolstring of claim 2, wherein said toolstring comprises a spaceout pipe string arranged above or below said mud motor.

8. The toolstring of claim 2, wherein said mandrel has an axial through bore so as for conducting flow from said drill pipe string to said mud motor and said casing cutter tool.

9. The toolstring of claim 1, further comprising a rotatable taper mill.

10. The toolstring of claim 9, wherein said toolstring comprises a spaceout pipe string arranged above or below said mud motor.

11. The toolstring of claim 2, further comprising a no-go sub arranged above said pipe spear, closer than said predetermined initial distance L.

12. The toolstring of claim 9, further comprising a no-go sub arranged above said pipe spear, closer than said predetermined initial distance L.

13. The toolstring of claim 9, wherein said mandrel has an axial through bore so as for conducting flow from said drill pipe string to said mud motor and said casing cutter tool.

14. The toolstring of claim 1, further comprising a no-go sub arranged above said pipe spear, closer than said predetermined initial distance L.

15. The toolstring of claim 14, wherein said mandrel has an axial through bore so as for conducting flow from said drill pipe string to said mud motor and said casing cutter tool.

16. The toolstring of claim 1, wherein said slots are axial slots along an outside of said mandrel.

17. The toolstring of claim 1, wherein a depth of said slots increases towards an end of said mandrel that is configured to point upwards in said well.

18. The toolstring of claim 1, wherein said dogs of said tag sub are secured towards a shallow end of said slots.

19. The toolstring of claim 1, wherein said dogs of said tag sub are configured to axially and radially slide into said slots when weight-loaded on said protrusion.

20. The toolstring of claim 1, wherein a distance between said knives and said dogs of said tag sub corresponds to a distance between said protrusion and said slips lock.

21. A method for conducting an axial position-controlled operation in a well, comprising the steps of:

a) assembling said toolstring according to claim 1;

b) running said toolstring into a well;

c) landing said dogs of said tag sub on a protrusion in said well, thus positioning said knives of said casing cutter tool at said predetermined initial distance L below said protrusion;

d) rotating said knives of said casing cutter tool, thus cutting free a pipe component of said well, wherein said pipe component is a polished bore receptacle, and said knives cut slips and/or a slips lock thus freeing said polished bore receptacle;

e) weight loading said dogs to collapse to move said tag sub downwardly past said protrusion of said well;

f) running said pipe spear into said pipe component that has been cut free;

g) setting said pipe spear in said pipe component that has been cut free; and h) pulling said pipe component that has been cut free out of hole.

22. The method according to claim 21, wherein step (f) includes running said pipe spear into said pipe component that has been cut free until a no-go sub lands on said protrusion.

23. The method according to claim 21, wherein step (d) includes rotating said knives by rotating said drill pipe string from surface or rotating said knives by running a mud motor that is included in said toolstring above said casing cutter tool.

24. A method for conducting an axial position-controlled operation in a well, comprising the steps of:

a) assembling said toolstring according to claim 2;

b) running said toolstring into a well;

c) landing said dogs of said tag sub on a protrusion in said well, thus positioning said knives of said casing cutter tool at said predetermined initial distance L below said protrusion;

d) rotating said knives of said casing cutter tool, thus cutting free a pipe component of said well, wherein said pipe component is a polished bore receptacle, and said knives cut slips and/or a slips lock thus freeing said polished bore receptacle;

e) weight loading said dogs to collapse to move said tag sub downwardly past said protrusion of said well;

f) running said pipe spear into said pipe component that has been cut free;

g) setting said pipe spear in said pipe component that has been cut free; and h) pulling said pipe component that has been cut free out of hole.

25. An axial position-controlled operation toolstring for conducting an axial position-controlled operation for releasing a pipe component in a well, comprising from below and up:

a casing cutter tool comprising knives;

a tag sub with dogs arranged for landing on a protrusion in said well;

a pipe spear; and a drill pipe string, wherein said knives of said casing cutter tool are spaced out a predetermined initial distance L below said dogs of said tag sub, and wherein said tag sub comprises a mandrel provided with axial slots having a depth which increases from a shallow, lower end towards an upper, deeper end, and said dogs of said tag sub are secured in and protruding from said shallow, lower slot end, and said dogs are arranged for collapsing into said slots when weight-loaded on said protrusion.

* * * * *